United States Patent [19]

Pleis

[11] 4,000,552

[45] Jan. 4, 1977

[54] HYDRAULIC HOSE SKIVING MACHINE

[75] Inventor: Duane R. Pleis, Brandon, S. Dak.

[73] Assignee: Dakota Iron, Inc., Sioux Falls, S. Dak.

[22] Filed: Nov. 10, 1975

[21] Appl. No.: 630,169

[52] U.S. Cl. ..... 29/76 R; 15/88; 51/90

[51] Int. Cl.[2] ..... B23D 67/00

[58] Field of Search ..... 29/76; 81/9.51; 157/13; 51/103 R, 105 R, 90; 15/88; 90/12 R

[56] References Cited

UNITED STATES PATENTS

| | | | |
|---|---|---|---|
| 1,737,707 | 12/1929 | Dickson | 51/90 |
| 3,134,202 | 5/1964 | Hoefler | 51/90 |
| 3,212,185 | 10/1965 | Keiter | 15/88 X |

*Primary Examiner*—Leonidas Vlachos
*Attorney, Agent, or Firm*—Wegner, Stellman, McCord, Wiles & Wood

[57] ABSTRACT

A machine for preparing hydraulic or any other type of hose to receive metallic couplings. Hose in desired inches or feet of length cut from a longer supply may be skived on an end to prepare the hose to receive a coupling crimped on to the hose. The exterior rubber covering of the hose may simply be trued so as to be concentric with the interior, sometimes referred to as a buffing operation done with an abrasive buffing wheel, or more material removed to expose reinforcing, such as a wire braid, in the hose to which the coupling is attached.

6 Claims, 3 Drawing Figures

HYDRAULIC HOSE SKIVING MACHINE

BACKGROUND OF THE INVENTION

Hydraulic hose, as well as pneumatic hose, is generally manufactured in long lengths supplied in coiled form to manufacturers who cut to desired length and attach couplings. In some applications, a few inches of hose may be all that is necessary, and generally require a coupling on either end. The secondary manufacturer who attaches the couplings generally cuts the hose to appropriate lengths and attaches the coupling parts to each end of the hose as required by the ultimate user.

The skiving operation generally is used to remove some of the outer rubber covering so that the coupling can appropriately be attached to it. A fast moving wire brush may remove the rubber covering down to expose reinforcing, such as a wire braid, to which the coupling may be attached. In some lower pressure operations, the outer rubber covering of the hose merely needs to be made concentric with the interior in which case the skiving would consist of a buffing to remove a thin layer of rubber. Skiving as used herein shall mean either removing enough of the hose covering to expose a reinforcement therein or to simply buff for purposes of making the exterior of the hose concentric with the interior.

There have been skiving machines where a hose is rotated upon its own center against a buffing wheel or wire brush. The turning of the hose on its own center has generally been accomplished manually.

In the present invention, an extremely safe to operate machine has a structure whereby the operator merely inserts the hose into the machine, steps on a foot pedal motor switch whereby the hose on a mandrel is carried circularly around the skiving tool generally to the point of beginning whereupon the hose may be removed from the machine and will be properly prepared to receive a coupling.

SUMMARY OF THE INVENTION

It is the principle object of this invention to make a hose skiving and buffing machine which is fast operating, economical to utilize and very accurate in its skiving and buffing operation on hose with little human judgment necessary to produce the accurate product.

Another object is to make a skiving machine which is quite safe to use with little or no operator exposure to injury.

Another object is to have a compact single skiving machine capable of handling a wide variety of hose sizes, with minimal set up time.

Another object is to provide such a machine which is controllable by the operator as to its speed of operation and in which all moving parts of the machine that are exposed to the operator are controllable by the operator exclusively so as to be extremely safe in use.

PREFERRED EMBODIMENT OF THE INVENTION

Figure 1:
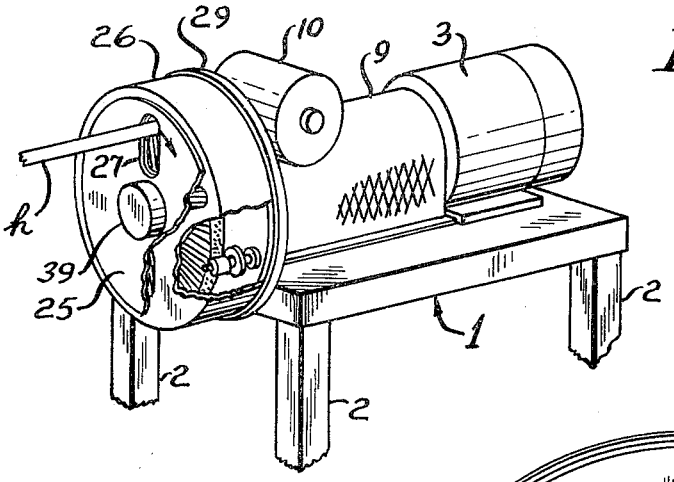
FIG. 1 is a fragmentary perspective view, partially broken away for clarity of illustration, of the machine of this invention.

The machine is intended to occupy space on a factory floor and to operate at substantially workbench height. The machine itself has a frame 1 supported upon legs 2 and is of a total overall size of about 18 inches wide and 26½ inches long. The frame 1 may conveniently be made of channel iron, so that it may provide strong support for a tool driving motor 3 driving a shaft 4 on which is mounted a skiving tool, such as wire brush 5, sandwiched between backing plates 6 and 7 and held on the end of shaft 4 by a threaded nut 8.

The space between the driving motor 3 and the skiving tool is covered with a mesh guard 9 which also encloses bearing supports for the other moving parts of the machine. A mandrel carrier drive motor 10 through an appropriate gear box drives a mandrel carrier through a sprocket 11 mounted rearwardly of the mandrel carrier plate 12 by an intervening bearing spacer 13 upon bearings **13*a* and 13*b*. As viewed in FIG. 1**, the front of the machine is where the hose *h* may be inserted into the machine to receive a skiving operation. The tool driving motor 3 may appropriately be 5 h.p. electric motor operating at 3,600 r.p.m. The mandrel plate drive motor may appropriately be ¼ h.p. with a 10:1 gear box and the motor being DC so as to be controlled in speed with a silicon rectifier so that the rotation of the carrier may be appropriately selected from 0 to 90 r.p.m.

Figure 3:
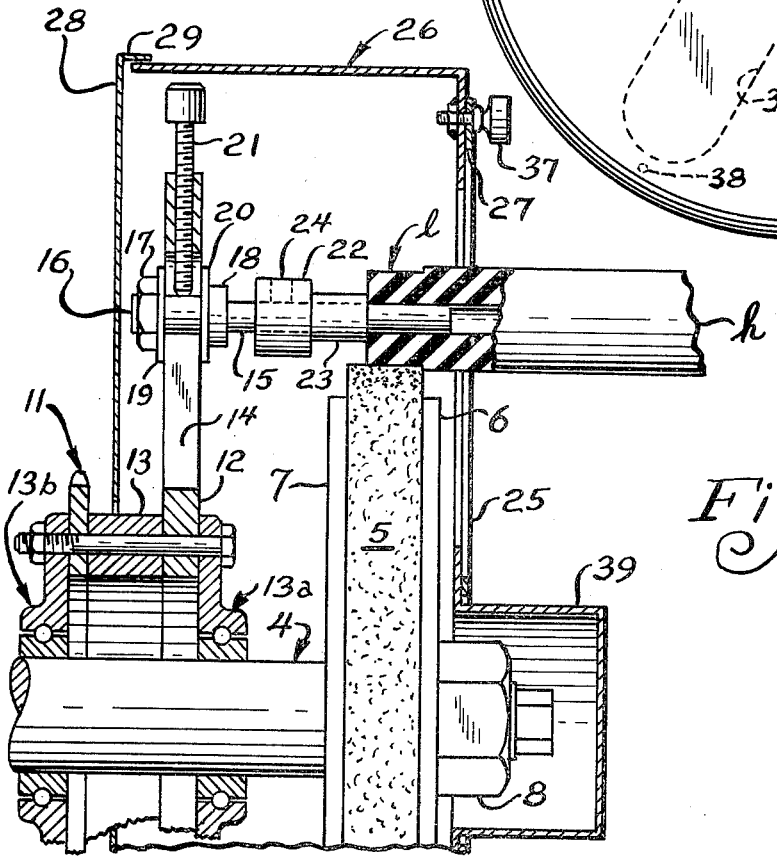
FIG. 3 is a partial sectional view, substantially along line 3—3 of FIG. 2, with parts of the machine removed for clarity of illustration.

An operator of the present skiving machine may take a hose end in his hand and put it over a finger-like mandrel in the machine, step on the foot control which will then cause the hose to follow a circular path around the periphery of the rotating skiving tool whereupon the skiving operation is finished. The mandrels are carried on the mandrel carrier plate 12 in a position to be adjusted in position relative to the skiving tool 5. For example, in FIG. 3, mandrel 15 has a threaded end 16 extending through a slot 14 extending radially in the plate 12. A nut 17 captures the mandrel in position on the plate against a flange 18 on one side of the plate abutting a washer 20 as the nut abuts a washer 19 on the opposite side of the plate. A radially directed adjusting screw 21 abuts the portion of the mandrel in the slot 14 preventing movement of the mandrel radially outwardly. The nut 17 is relied upon to hold the mandrel in place.

The mandrel is positioned with its finger-like portion 15 to extend along an axis parallel to the drive shaft 4 and past the periphery of the skiving tool. The finger part of the mandrel is of a diameter to fit the interior bore of the hose. Thus, a ¼ inch mandrel fits the interior of a ¼ inch hose. A collar 24 with a smaller sized extension 23 facing the hose *h* may be secured to the mandrel 15 by set screw 24 to limit the inward movement of the hose so that an appropriate length *l* of hose end will be skived.

As illustrated in the figures, the moving parts of the machine are shrouded. A facing plate 25 has a single oblong opening 27 which fits over one of the mandrels, each of which is opposite an oblong opening, such as the opening 30 in a main shroud 26. A back cover 28 with its forwardly extending flange 29 is stationary on the machine, the main shroud 26 being carried by the mandrel carrier plate 12.

Figure 2:
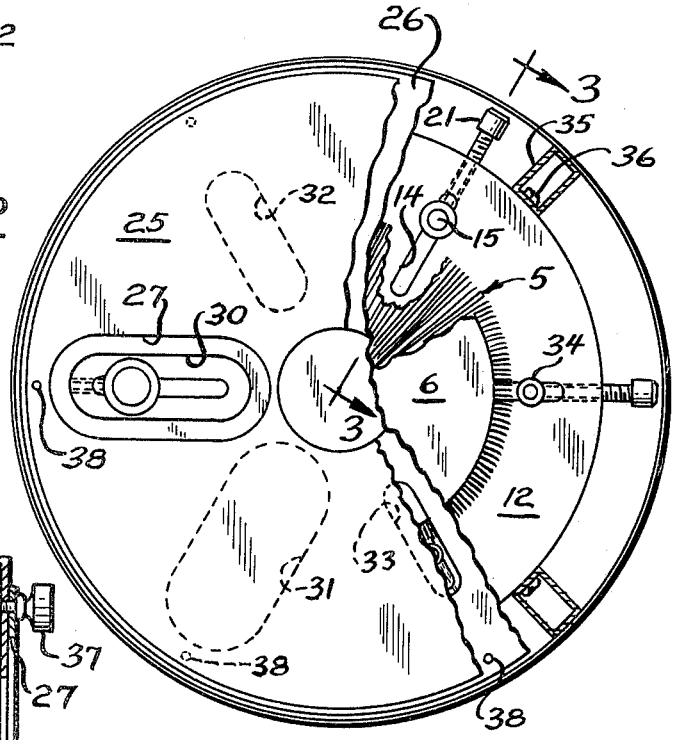
FIG. 2 is a front view of the hose receiving end of the machine with parts broken away for clarity of illustration.

As illustrated best in FIG. 2, the main shroud has an oblong opening 31 over a 1 inch hose mandrel, an oblong opening 32 over a ½ inch mandrel, and an opening 33 over a ⅜ inch mandrel. A mandrel 15 is of the 3/16 inch size and mandrel 34 is for ¼ inch hose size. Appropriate openings like those illustrated as 31 to 33 located as well over mandrels 15 and 34. The main shroud is supported at four 90° apart positions by a plurality of small hollow tubes 35 within each of which a fastener 36 is accessible from the outside so as to attach the shroud to the periphery of the mandrel carrier. The tubes 35 are secured to the main shroud and the carrier plate 12 is bored and threaded to receive fasteners 36.

The front face plate may be quickly and easily attached to the main shroud in several positions by the use of knobs 37 on fasteners placeable in threaded openings 38 in the main shroud. The cup-shaped covering 39 over the end of the main drive shaft is a part of the main shroud.

In operation, an operator will place the face plate 25 with its opening 27 over the desired size of hose mandrel for the hose to be skived at a particular time. The mandrel will be adjusted in its radially directed supporting slot to skive the desired amount of material from the hose. A collar will be adjusted to allow the hose the proper "depth" of movement onto the mandrel.

The drive motor is activated which runs the skiving tool at a standard 3,600 r.p.m. The operator may adjust the silicon rectifier on the mandrel carrier motor 10 control to provide the speed at which he will comfortably insert hoses on the mandrels and allow them to turn one turn around the skiving tool. A foot control pedal stops and starts the carrier. One operator may prefer to start at approximately 3 o'clock position and to end at such a position, and another may prefer to start and stop, for example, at a 12 o'clock position. Such may be done with the full control through the foot pedal for stopping and starting the drive motor 10.

It is preferred by most operators that the mandrel turn in clockwise direction, and thus the skiving tool is rotated in a counterclockwise direction opposed to the hose passed around the tool. It would make no difference if more than one revolution were made since the mandrel securely holds the hose in a fixed position at the periphery of the tool and additional revolutions do not remove any more material than desired. One revolution is generally enough, whether a wire brush or an abrasive buffing wheel is attached to the shaft 4 in the position of the wire brush 5 illustrated.

I claim:

1. A hydraulic hose skiving machine for preparing hose to receive couplings, comprising:

a frame , a high speed rotary motor driven skiving tool mounted on the frame for rotation about a fixed axis, a mandrel support rotatable about the skiving tool, a mandrel secured to said support and cantilevered past said skiving tool for receiving a hose end telescoped thereover, said mandrel carried in predetermined desired spacing from said tool, and power means for turning said support to carry the mandrel about the periphery of said skiving tool for removing a desired thickness layer of material from a hose end on the mandrel.

2. A machine as specified in claim 1 wherein the mandrel is adjustable on its support toward and away from the skiving tool for changing the depth of material removable from a hose end on the mandrel.

3. A machine as specified in claim 1 wherein the skiving tool is rotated in one direction and the mandrel is revolved about the tool in counter direction.

4. A machine as specified in claim 1 wherein the skiving tool is rotated at constant speed and means are provided for varying the revolving speed of the mandrel support about the tool.

5. A machine as specified in claim 1 wherein the skiving tool and mandrel carrier are housed with a covering shroud mounted for movement with the carrier, said shroud having an opening over the mandrel for insertion of a hose end over the mandrel.

6. A machine as specified in claim 1 wherein the mandrel carrier is a plate having a plurality of circumferentially spaced mandrels thereon, each individually adjustably radially movable toward and away from the skiving tool.

* * * * *